US006475569B1

(12) United States Patent
Ogura

(10) Patent No.: US 6,475,569 B1
(45) **Date of Patent: *Nov. 5, 2002**

(54) ELECTROPHOTOGRAPHIC TRANSFER PAPER

(75) Inventor: Motohiro Ogura, Odawara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/407,085

(22) Filed: Sep. 28, 1999

(30) Foreign Application Priority Data

Sep. 29, 1998 (JP) ..... 10-275824

(51) Int. Cl.[7] ..... B05D 3/02
(52) U.S. Cl. ..... 427/395; 427/209; 427/391
(58) Field of Search ..... 428/198, 29, 220, 428/327, 340, 341, 342; 427/395, 391, 208, 209, 421, 420, 428

(56) References Cited

U.S. PATENT DOCUMENTS 4,778,711 A 10/1988 Hosomura et al. ..... 428/211
4,944,997 A * 7/1990 Nielsen ..... 428/327
5,633,041 A * 5/1997 Arrington ..... 427/361
5,637,383 A * 6/1997 Sakurai et al. ..... 428/211
5,662,995 A 9/1997 Sakurai et al. ..... 428/304.4
5,725,946 A * 3/1998 Fukushima et al. ..... 428/342
6,063,538 A * 5/2000 Hayashi et al. ..... 430/124

FOREIGN PATENT DOCUMENTS

| | | |
|---|---|---|
| EP | 0 718 701 | 6/1996 |
| JP | 08-171225 | 7/1996 |
| JP | 09-034157 | 2/1997 |
| JP | 09-034158 | 2/1997 |

* cited by examiner

*Primary Examiner*—Shrive P. Beck
*Assistant Examiner*—Rebecca A. Blanton
(74) *Attorney, Agent, or Firm*—Fitzpatrick, Cella, Harper & Scinto

(57) ABSTRACT

An electrophotographic transfer paper of the present invention has a basis weight of 60 to 100 g/m$^2$, which is coated by a film at least on one side, and has an average surface centerline roughness (Ra) of 1.5 $\mu$m or less, volume resistivity of $1\times10^9$ Ωcm or more at 30° C./80% RH and paper stiffness of 16 cm or more, and prevents uneven discharge under low humidity conditions, and produces no faulty images and shows sufficient paper transportability under high humidity conditions.

4 Claims, 1 Drawing Sheet

ELECTROPHOTOGRAPHIC TRANSFER PAPER

BACKGROUND OF THE INVENTION

1. Field of the Invention

This invention relates to an electrophotographic transfer paper, more particularly an electrophotographic transfer paper to be used in an electrophotographic apparatus, electrostatic recording apparatus or the like, which prevents uneven discharge under low humidity conditions, and produces no faulty images and shows satisfactory paper transportability under high humidity conditions.

2. Related Background Art

Heretofore, color recording apparatus for electrophotography have been increasingly digitized to produce images of higher qualities, which needs a electrophotographic transfer paper to exhibit more uniform transferability. The characteristics of the transfer paper which affect toner transferability are electric resistance and surface properties of paper.

Resistance of the transfer paper is one of the most important properties in the art of electrophotography, and has been controlled at $1\times10^{9}$ to $1\times10^{11}$ Ωcm as surface resistivity and volume resistivity with the aid of an agent to improve electroconductivity. However, it is very difficult to control the conductivity, because it changes with water content of the paper, i.e., humidity in the atmosphere in which it is used. Today's highly functional electrophotographic copiers and printers are designed so that the toner can be transferred to the transfer paper in an ambient environment under which they operate. As a result, they are designed to produce good images over a wide temperature/humidity condition range from a low-temperature/low-humidity condition of 10° C./5% RH to a high-temperature/high-humidity condition of 30° C./80% RH.

The transfer paper used to produce full-color images, having a basis weight of 60 to 100 g/m$^2$, has a high moisture content, and is very sensitive to ambient humidity. As a result, it tends to have an excessive resistance, when handled at low-humidity circumstances, e.g., 15° C./20% RH and 23° C./5% RH, due to partial discharging phenomenon resulting from uneven charging on the paper surface, causing a problem known as a blank area in image. This type of problem results from discharging in an area where the transfer paper is separated, after an image is transferred thereto, from the photosensitive drum, and tends to be aggravated as resistance of the transfer paper increases.

Japanese Patent Application Laid-Open No. 8-171225 proposes adjustment of surface resistivity and volume resistivity of a transfer paper. However, the transfer paper having the above range of basis weight has a very high moisture content and is sensitive to ambient humidity. Keeping the resistance at a low level will cause another problem of leakage, when the paper is handled under a high humidity condition. In other words, the paper passes an excessive quantity of current, to prevent the image, or toner, from smoothly transferring thereto.

Japanese Patent Application Laid-Open No. 9-34158 proposes to increase smoothness of transfer paper surface, in order to secure uniform charging thereon.

However, when the transfer paper having the above range of basis weight is provided with a smoothness on the surface, an ordinary transfer paper may be damaged to loose firmness when coated and treated by, e.g., calendering. Usually, therefore, the paper of ordinary grade has not been treated for surface smoothness.

SUMMARY OF THE INVENTION

It is an object of the present invention to provide an electrophotographic transfer paper to resolve the above problems.

It is another object of the present invention to provide an electrophotographic transfer paper to be used in an electrophotographic apparatus, electrostatic recording apparatus or the like, which prevents uneven discharge under low humidity conditions, and produces no faulty images and shows sufficient paper transportability under high humidity conditions.

In accordance with the present invention, there is provided an electrophotographic transfer paper having a basis weight of 60 to 100 g/m$^2$ comprising a coating layer provided at least on one side of the paper, and having an average surface centerline roughness (Ra) of 1.5 μm or less, a volume resistivity of $1\times10^{9}$ Ωcm or more at 30° C./80% RH and a paper stiffness of 16 cm or more.

The electrophotographic transfer paper of the present invention, having the above characteristics, prevents uneven discharge under low humidity conditions, and produces no faulty images and shows sufficient paper transportability under high humidity conditions.

The average centerline roughness (Ra) is determined in accordance with JIS-B0601 (1982). The volume resistivity is determined in accordance with provision JIS K-6911.

The paper stiffness is determined by finding length of the specimen strip of certain shape between the upper end point from which it is suspended and the lower end, when the specimen is rotated by 90° on the axis of the line passing the upper end point in such a way that the lower end droops in the direction opposite to the specimen rotational direction. It is determined in the direction perpendicular to the paper-making direction, in accordance with provision JIS-P8143.

DETAILED DESCRIPTION OF THE PREFERRED EMBODIMENTS

A transfer paper for use in electrophotography of the present invention has preferably a basis weight of 60 to 100 g/m$^2$. The transfer paper comprises a coating layer provided at least on one side of the paper. Preferably, it should have an average surface centerline roughness (Ra) of 1.5 μm or less, a volume resistivity of $1\times10^{9}$ Ωcm or more at 30° C./80% RH and a paper stiffness of 16 cm or more.

The present invention will be described by referring to the attached drawings.

Figure 1:
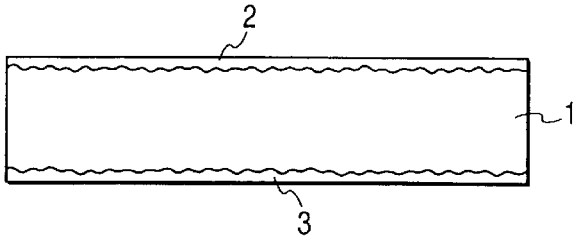
FIG. 1 schematically illustrates a cross-sectional view of the model configuration of the full-color electrophotographic transfer paper of the present invention.

FIG. 1 illustrates a transfer paper of the present invention, where a substrate 1 may be of acidic or neutral, woodfree paper, neutralized paper, groundwood paper, regenerated paper. However, it is preferable that the transfer paper contains no additive for decreasing resistance such as an agent for increasing electroconductivity and has a volume resistivity of $1\times10^{9}$ Ωcm or more. Furthermore, preferably it has a volume resistivity of $1\times10^{16}$ Ωcm or less.

The coating layers 2 and 3 which may be formed at least on one side of the substrate may be of a usual pigment. The pigments useful for the present invention include mineral pigments, e.g., heavy potassium carbonate, light potassium carbonate, titanium dioxide, aluminum hydroxide, satin white, talc, calcium sulfate, barium sulfate, zinc oxide, magnesium oxide, magnesium carbonate, amorphous silica, colloidal silica, white carbon, kaoline, sintered kaoline, delaminated kaoline, aluminosilicate, sericite and bentonite; and organic pigments, e.g., fine particles of polystyrene resin, fine particles of urea formaldehyde resin and fine hollow particles thereof. They may be used either individually or in combination.

The adhesive for the coating layer may be a usual one, so long as it is sufficiently adhesive to the substrate and additives, e.g., pigment. The adhesives useful for the present invention include water-soluble adhesives, emulsion and latex, which may be used individually. Examples of these adhesives are water-soluble resins, e.g., polyvinyl alcohol, modified polyvinyl alcohol, starch, gelatin, casein, methyl cellulose, hydroxyethyl cellulose, acryl amide/acryl ester copolymer, terpolymer of acryl amide/acryl resin/methacrylic acid, styrene/acryl resin, isobutylene/maleic anhydride resin, and carboxymethyl cellulose; and emulsions or latex, e.g., acrylic emulsion, vinyl acetate emulsion, vinylidene chloride emulsion, polyester emulsion, styrene/butadiene latex, and acrylonitrile/butadiene latex.

It is necessary, when the coating is effected by gate rolling, an ordinary on-machine coating method, to dispense with calendering or to operate it at a lower pressure than that normally used. This is to make the surface smooth without damaging the paper. The off-machine coating methods useful for the present invention include blade, air knife, roll and curtain coating methods. However, the method applying little pressure to the paper, e.g., the one which uses a silk screen, is preferable.

The coating quantity or weight of the coating layer or film is preferably in a range from 1 to 20 g/m$^2$. At below 1 g/m$^2$, the surface centerline roughness may exceed 1.5 $\mu$m. At above 20 g/m$^2$, on the other hand, the paper may be excessively firm as to deteriorate transportability of the transfer paper in the electrophotographic apparatus.

Coating pressure is preferably 50 kg/cm$^2$ or less. At above 50 kg/cm$^2$, the paper may be damaged, and its stiffness may be below 16 cm. The paper having a stiffness of below 16 cm may twine around the fixing roller, when it passes the heat roller.

The paper configuration of the present invention has a high volume resistivity as a whole, preventing leakage as a phenomenon occurring under a high humidity condition.

Figure 2:
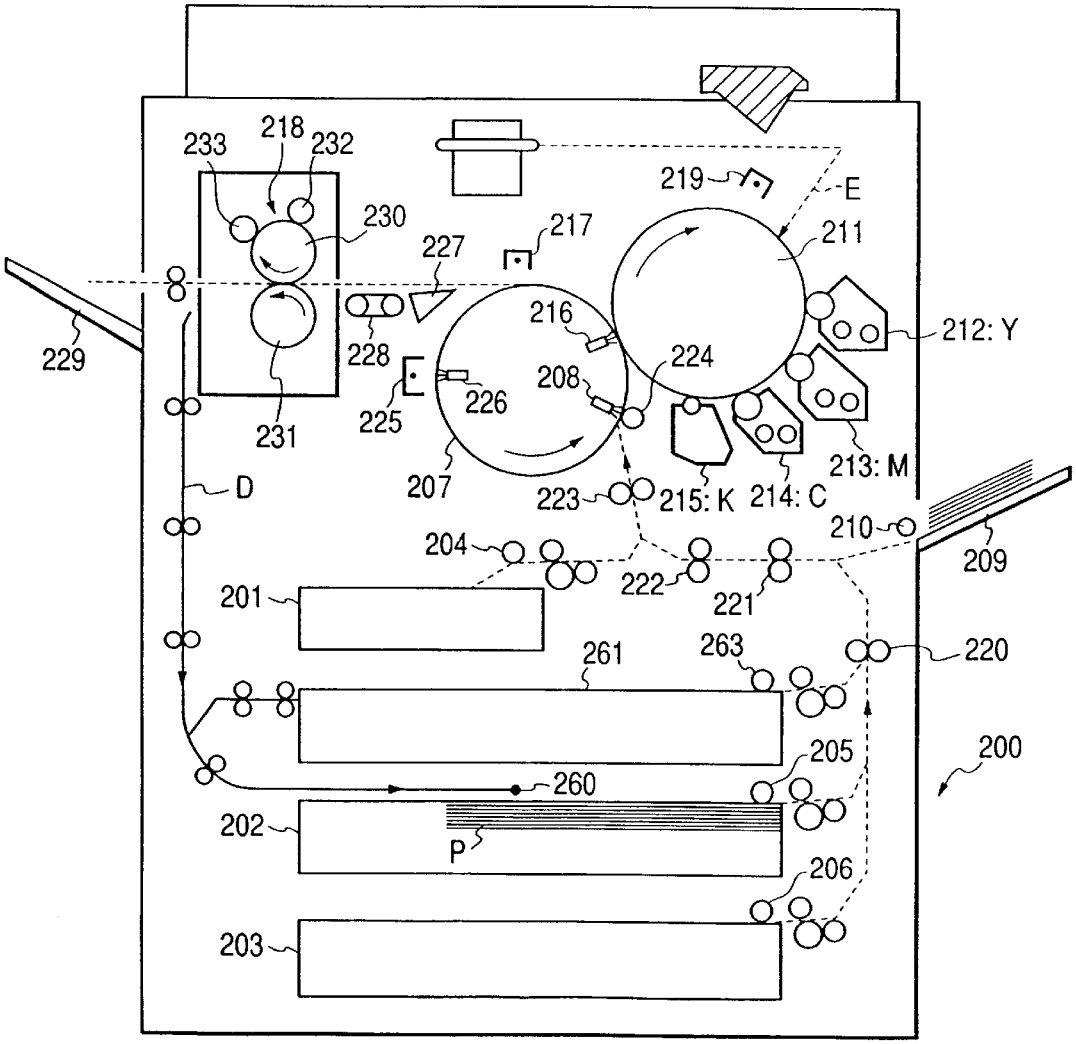
FIG. 2 shows the configuration of an electrophotographic apparatus for a multiple transfer system.

The electrophotographic apparatus, in which the transfer paper of the present invention can be used, has been already commercialized for multiple transfer systems, and one example is illustrated in FIG. 2.

This electrophotographic apparatus 200 is equipped with a yellow developing device 212, magenta developing device 213, cyan developing device 214 and black developing device 215 around a photosensitive drum 211, these developing devices being mounted detachably in the order of image formation. It is also equipped with a rotatable transfer drum 207, charging device 219 required to produce latent images, and image exposure system E. The rotatable transfer drum 207 electrostatically transfers the toner images one after another from the photosensitive drum to the transfer paper, e.g., film, which is wound around the drum 207. When a full-color image is formed by the apparatus 200, a transfer paper P, taken out of a paper supply tray 202 or the like by a paper; supplying roller 205 or the like, is transported in the direction of the arrow by transporting rollers 220, 221, 222 and 223 to the transfer drum 207, around which it is wound by electrostatic adsorption with the aid of an adsorption brush 208. Multi-color toner images are transferred one after another, following the image forming procedure, from the photosensitive drum 211 to the transfer paper P on the transfer drum 207.

The transfer of the toner images is effected by a transfer brush 216. More concretely, the back face of the transfer drum 207 is charged with a charge having polarity opposite to that on the toner, given from the inside of the transfer drum 207, comprising a dielectric sheet (e.g., of polyvinylidene fluoride-PVDF), to the transfer brush 216. Therefore, the transfer is effected by attracting the toner to the surface of the transfer paper on the dielectric sheet in the electrical field generated by the given charge. This transfer is repeated many times for the toners of magenta (M), cyan (C), yellow (Y) and black (K) colors, to form the images of these colors on the transfer paper. These color toners are melted and mixed with each other, when the transfer paper is passed through a thermal fixation device 218, to produce a full-color image.

The transfer material transporting system is provided with transfer paper supply trays 201, 202 and 203 below the electrophotographic apparatus 200, paper supplying rollers 204, 205 and 206, each being positioned almost directly above the corresponding trays 201, 202 and 203, paper transporting rollers 220, 221, 222 and 223 located in the vicinity of the paper supplying rollers; a transfer roller 224, separated charger 217 and static eliminating charger 225 around the outer periphery of the transfer drum, in this order from the upstream of the rotational direction; and adsorption brush 208, transfer brush 216 and static eliminating brush 226 inside of the transfer drum 207.

The other members include a transfer drum 207 freely rotating in the direction of arrow in FIG. 2, a separation claw 227 in the vicinity of the transfer drum 207, transporting belt means 228 in the vicinity of the claw 227, and thermal fixation device 218, which is in the vicinity of the end terminal in the transportation direction of the transporting belt means, extending out of the electrophotographic apparatus 200 and in the vicinity of a discharge tray 229 freely attached to or detached from the apparatus 200.

The thermal fixation device 218 is equipped with a fixation roller 230 with a built-in heater, pressurizing roller 231 facing the fixation roller 230, release agent applicator 232 which applies a release agent, e.g., silicone oil, onto the fixation roller 230, and fixation roller cleaning device 233.

When the double-side transfer is effected, the paper is transported in the direction D in FIG. 2 and turned at the turning path 260 back to the double-side unit 261. It is supplied by a paper supplying roller 263, similar to the above-mentioned paper supplying roller, and an image is then formed thereon in a similar manner to the above image forming method.

The present invention is described more concretely by Examples, which by no means limit the present invention.

EXAMPLE 1

Paper was made by a Fourdrinier machine from L.B.K.P. (Lanbholz Bleached Kraft Pulp), incorporated with 6 wt. % (on the dry weight basis) of titanium oxide, 6 wt. % of kaoline, 90.5 wt. % of aluminum sulfate and 0.3 wt. % of rosin sizing agent, and then mixed with 3.2 wt. % of water-soluble binder to prepare a pulp suspension. The paper was dried to have a moisture content of 5%. The high-quality paper thus prepared was coated with a coating agent (styrene/butadiene latex resin as a water-soluble adhesive, incorporated with calcium carbonate as a pigment, quantity of which was adjusted in such a way to have a dry weight of 1 g/m$^2$ by the aid of a silk screen, to have a surface centerline roughness (Ra) of 1.0 $\mu$m. It was then dried to have a stiffness of 20 cm in the CD direction, perpendicular to the paper-making direction. The paper thus prepared had a basis weight of 90 g/m$^2$, and volume resistivity of $1\times10^{10}$ Ωcm at 30° C./80% RH.

The transfer paper thus prepared was passed through a full-color copier CLC-800 supplied by CANON to form a full-color image thereon, and assessed for its image uniformity, transfer efficiency and twining of the paper on the fixation device under the conditions of 23° C./60% RH, 23° C./5% RH and 30° C./80% RH. The results are given in Table 1.

As shown in Table 1, the image was highly uniform, showing no uneven transfer or blank area caused by uneven discharge, and no twining of the paper on the fixation device was observed.

EXAMPLE 2

The same procedure as used for Example 1 was repeated, except that the concentration of the pulp suspension was decreased to prepare a transfer paper having a basis weight of 81.4 g/m$^2$ and stiffness of 18.5 cm in the CD direction. Physical properties of the transfer paper are given in Table 1. The transfer paper thus obtained was assessed in the same manner as in Example 1. It was confirmed that similarly to Example 1 the transfer paper carried a highly uniform image, showing no uneven transfer or blank area caused by uneven discharge. The results are given in Table 1.

EXAMPLE 3

The same procedure as used for Example 1 was repeated, except that the concentration of the pulp suspension was further decreased to prepare a transfer paper having a basis weight of 64 g/m$^2$ and stiffness of 17.2 cm in the CD direction. Physical properties of the transfer paper are given in Table 1. The transfer paper thus obtained was assessed in the same manner as in Example 1. It was confirmed that similarly to Example 1 the transfer paper carried a highly uniform image, showing no uneven transfer or blank area caused by uneven discharge. The results are given in Table 1.

COMPARATIVE EXAMPLE 1

The same procedure as used for Example 1 was repeated, except that an ordinary method of on-line calendering treatment was carried out instead of the silk screen coating, to prepare transfer paper. The transfer paper thus produced was assessed in the same manner as in Example 1. The results are given in Table 1. As shown, uneven discharge occurred.

COMPARATIVE EXAMPLE 2

The same procedure as used for Example 1 was repeated, except that after the silk screen coating, the on-line calendering treatment was performed followed by supercalendering treatment, to prepare a transfer paper having a surface centerline roughness of 0.5 $\mu$m. The transfer paper was assessed in the same manner as in Example 1. The results are given in Table 1. Twining of the paper on the fixation device was observed.

COMPARATIVE EXAMPLE 3

The same procedure as used for Example 1 was repeated, except that 2.5 wt. % of an electroconductive agent was additionally used during the preparation of paper, to prepare a transfer paper having a volume resistivity of $1\times10^8$ Ωcm at 30° C./80% RH. The transfer paper thus obtained was assessed in the same manner as in Example 1. The results are given in Table 1.

TABLE 1

| | | Example 1 | Example 2 | Example 3 | Comparative Example 1 | Comparative Example 2 | Comparative Example 3 |
|---|---|---|---|---|---|---|---|
| Basis weight | g/m$^2$ | 90 | 81.4 | 64 | 90 | 90 | 90 |
| Coating weight | g/m$^2$ | 2 | 2 | 2 | 0 | 2 | 2 |
| Volume resistivity | Ωcm at 30° C./80% | $1\times10^{10}$ | $8\times10^9$ | $2\times10^9$ | $1\times10^{10}$ | $1\times10^{10}$ | $1\times10^8$ |
| Paper stiffness | cm | 20 | 18.5 | 17.2 | 20 | 15 | 20 |
| Surface centerline roughness | $\mu$m | 1 | 0.7 | 0.5 | 1.8 | 0.5 | 0.5 |
| Image quality | (23° C./5%) | Good | Good | Good | Bad | Good | Good |
| Twining of the paper on the fixation device | | Good | Good | Good | Good | Paper could not pass through the copier | Good |
| Discharge leakage | (30° C./80%) | Good | Good | Good | Good | Good | Leakage observed |

(Notes)

For image quality, "bad" means there was one or more blank areas in places, caused by uneven transfer in the direction of the paper thickness, whereas "good" means there was no uneven area in the image.

For twining of the paper on the fixation device, "paper could not pass through the copier" means the transfer paper twining on the fixation roller and no transfer paper discharged from the copier, whereas "good" means no paper outlet jam was observed.

Discharge leakage is a phenomenon in which electric current flows not in the thickness direction but in the horizontal directions, due to excessively low resistance of the transfer paper, as a result of which no image is transferred leaving the paper blank, and "good" means no such a blank area observed in the image.

The volume resistivity was determined by an analyzer, Ultra-high Resistance Meter (trade name, supplied by ADVANTEST Co.) at an applied voltage of 100 V.

The average centerline roughness (Ra) was determined by a surface roughness meter, SE 3400 (trade name, made by Kosaka Laboratory) at a cut-off level of 0.8 mm and measurement length of 8 mm.

The paper stiffness was determined by a Clark stiffness tester (made by Kumagaya Riki Industries) for the 30 mm wide specimen.

What is claimed is:

1. A method for producing an electrophotographic transfer paper, comprising the steps of:

providing a paper substrate; and coating a coating agent containing a pigment and an adhesive at least on one side of the paper substrate at a pressure of 50 $kg/cm^2$ or less to form a coating layer, wherein said coating layer undergoes no calendering treatment, and wherein said transfer paper has the following characteristics:

(1) a basis weight of 60 to 100 $g/m^2$, (2) an average surface centerline roughness (Ra) of 1.5 $\mu$m or less on the surface of the coating layer, (3) a volume resistivity of $1\times10^9$ $\Omega$cm or more at 30° C./80% RH, and (4) a paper stiffness of 16 cm or more.

2. The method for producing an electrophotographic transfer paper according to claim 1, wherein said coating layer is formed by silk screen printing.

3. The method for producing an electrophotographic transfer paper according to claim 1, wherein said adhesive is a water soluble adhesive.

4. The method for producing an electrophotographic transfer paper according to claim 1, wherein said coating layer is provided at a coating weight of 1 to 20 $g/m^2$.

* * * * *

UNITED STATES PATENT AND TRADEMARK OFFICE

CERTIFICATE OF CORRECTION

PATENT NO. : 6,475,569 B1
DATED : November 5, 2002
INVENTOR(S) : Motohiro Ogura

It is certified that error appears in the above-identified patent and that said Letters Patent is hereby corrected as shown below:

Column 1,
Line 17, “a” should read -- an --.
Line 54, “leakage,” should read -- leakage --.

Column 2,
Line 59, “paper, regenerated” should read -- paper, or regenerated --.

Column 3,
Line 50, “been already” should read -- already been --.
Line 66, “paper;” should read -- paper --.

Column 5,
Line 1, “resin” should read -- resin) --.

Signed and Sealed this

Fifteenth Day of April, 2003

JAMES E. ROGAN
*Director of the United States Patent and Trademark Office*